US009423149B2

(12) United States Patent
Martinus

(10) Patent No.: US 9,423,149 B2
(45) Date of Patent: Aug. 23, 2016

(54) METHODS AND APPARATUSES TO ATTENUATE ACOUSTIC WAVES

(71) Applicant: TRANE INTERNATIONAL INC., Piscataway, NJ (US)

(72) Inventor: Ferdy Martinus, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/688,650

(22) Filed: Apr. 16, 2015

(65) Prior Publication Data

US 2015/0300682 A1 Oct. 22, 2015

Related U.S. Application Data

(60) Provisional application No. 61/980,303, filed on Apr. 16, 2014.

(51) Int. Cl.
*F01N 1/06* (2006.01)
*F24F 13/24* (2006.01)

(52) U.S. Cl.
CPC ..... *F24F 13/24* (2013.01); *F24F 2013/245* (2013.01)

(58) Field of Classification Search
CPC ..... F01N 1/065
USPC ..... 181/206
See application file for complete search history.

(56) References Cited

U.S. PATENT DOCUMENTS

| | | | |
|---|---|---|---|
| 3,948,348 | A | 4/1976 | Bychinsky |
| 3,948,349 | A | 4/1976 | Bychinsky |
| 4,165,798 | A | 8/1979 | Martinez |
| 4,359,134 | A | 11/1982 | Jackson |
| 4,600,076 | A | 7/1986 | Yamamoto et al. |
| 5,519,994 | A | 5/1996 | Hill |
| 7,380,635 | B2 | 6/2008 | Harris |
| 7,503,426 | B2 | 3/2009 | Yaoita |
| 7,946,383 | B2 | 5/2011 | Lynch |
| 8,122,732 | B2 | 2/2012 | Lee et al. |
| 2010/0111713 | A1 | 5/2010 | Chatfield et al. |

*Primary Examiner* — Forrest M Phillips
(74) *Attorney, Agent, or Firm* — Hamre, Schumann, Mueller & Larson, P.C.

(57) ABSTRACT

Apparatuses and methods to attenuate acoustic waves are provided. The method may include shifting the phases of a plurality of portions of the acoustic waves and merging the portions of the acoustic waves after phase shifting. Because, for example, the phases of the acoustic waves may be out-of-sync when being merged, the acoustic waves may be attenuated. A muffler incorporating the method of attenuating acoustic waves can include a plurality of acoustic paths, each of which may have different acoustic impedance and/or length. The acoustic paths may help the acoustic waves have out-of-sync phases after the acoustic waves passing through the acoustic paths, resulting in acoustic wave attenuation.

13 Claims, 6 Drawing Sheets

METHODS AND APPARATUSES TO ATTENUATE ACOUSTIC WAVES

FIELD

The disclosure herein relates to a method and an apparatus (such as a muffler) that can be used to attenuate acoustic waves. More specifically, the disclosure herein relates to a method and an apparatus that can be used to attenuate acoustic waves generated by, for example, a compressor in a heating, ventilation, and air conditioning (HVAC) system.

BACKGROUND

A muffler is often used to attenuate acoustic waves (e.g., sound) generated by a machine, such as for example, an engine or a compressor. In an HVAC system, an HVAC compressor is one of the major acoustic wave sources. A muffler can be used with the compressor to attenuate the acoustic waves generated by the compressor, which may help reduce an operational sound of the HVAC system. Reducing operational sound may be desirable, for example, in a school, during nighttime, or in other situations.

SUMMARY

Methods and apparatuses (such as a muffler) configured to attenuate acoustic waves are described herein. The embodiments as disclosed herein are generally configured to provide a different phase shift(s) to acoustic waves and merge the acoustic waves after the phase shifting. Because the acoustic waves may have different phases after the phase shifting, the acoustic waves can be attenuated when merged.

In some embodiments, a muffler may include a first acoustic path and a second acoustic path. The first and/or the second acoustic paths may be external or internal to a housing of the muffler. The first acoustic path and the second acoustic path may be configured to provide different phase shifts to acoustic waves, and the first acoustic path and the second acoustic path are configured to direct acoustic waves to merge after traversing the first and second acoustic paths.

In some embodiments, the first acoustic path and the second acoustic path may have different lengths, which may help provide different acoustic impedance when an acoustic wave passes through the first and second acoustic paths. In some embodiments, the first acoustic path and the second acoustic path may be configured to have different acoustic impedance by other suitable configurations (e.g., different cross-sectional areas, sudden expansion/contraction, and/or baffle structures, etc.). When the acoustic waves merge after passing through the first and second acoustic paths, the difference in the acoustic impedance may result in a destructive interference between the acoustic waves from the first and second acoustic paths.

In some embodiments, the muffler may include a muffler housing, and the first acoustic path may be internal to the muffler housing, and the second acoustic path may be external to the muffler housing or vice versa. In some embodiments, both or neither of the first acoustic path and the second acoustic path may be internal to the muffler housing.

In some embodiments, the muffler may include a third acoustic path. The third acoustic path can be configured to provide a different acoustic impedance (e.g., a phase shift, etc.) than one or both of the first and second acoustic paths. In some embodiments, the first and second acoustic paths may be internal to the muffler housing and the third acoustic path may be external to the muffler housing. In some embodiments, the first and second acoustic paths may be external to the muffler housing and the third acoustic path may be internal to the muffler housing.

In some embodiments, a method of attenuating acoustic waves may include providing a first degree of phase shift to a first portion of the acoustic waves; providing a second degree of phase shift to a second portion of the acoustic waves; and merging the first portion of the acoustic waves and the second portion of the acoustic waves. In some embodiments, the first degree of phase shift and the second degree of phase shift may be different.

Other features and aspects will become apparent by consideration of the following detailed description and accompanying drawings.

BRIEF DESCRIPTION OF THE DRAWINGS

Reference is now made to the drawings in which like reference numbers represent like parts throughout.

FIG. 3A illustrates an acoustic path that includes two contracted portions arranged in parallel and an expanded portion in communication with the contracted portions, according to some embodiments. FIG. 3B illustrates an acoustic path that includes two contracted portions and expanded portions arranged in series, according to some embodiments. FIG. 3C illustrates an acoustic path that includes an acoustic absorbing or phase shifting material, according to some embodiments. FIG. 3D illustrates an acoustic path that includes a perforated plate, according to some embodiments. FIG. 3E illustrates an acoustic path that includes a plurality of baffles, according to some embodiments.

DETAILED DESCRIPTION

Figure 1:
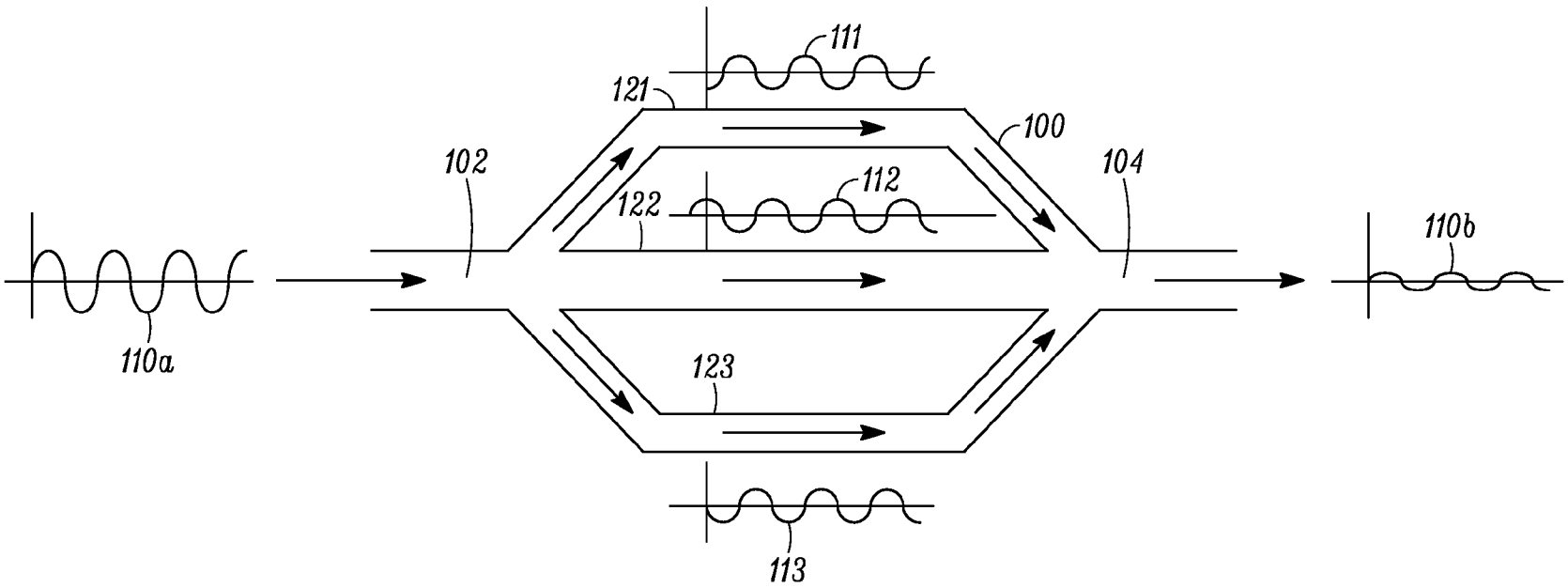
FIG. 1 illustrates a schematic diagram of a muffler, according to some embodiments.

A compressor (such as, but not limited to, a screw compressor) of an HVAC system is one major source of acoustic waves, causing operational sound of the HVAC system. Reducing the sound is often desirable, for example, in a school, at nighttime, or in other situations. A muffler can be added to the compressor to attenuate the acoustic waves of the compressor, which may help reduce the operational sound of the HVAC system. Traditionally, a muffler may be configured to trap acoustic energy into resonances inside the muffler, which may help reduce the acoustic energy passing through. The traditional muffler, for example, may be configured to direct the acoustic waves through a contracted structure and an expanded structure. The acoustic waves can be attenuated when directed between the contracted structure and the expanded structure, which helps trap the acoustic energy. However, such a muffler may be relatively large in size.

The embodiments disclosed herein are directed to methods and apparatuses to attenuate acoustic waves. A method of attenuating acoustic waves may include directing the acoustic waves into a plurality of acoustic paths. Each of the acoustic paths may provide a different acoustic impedance (e.g., a phase shift(s), etc.) to portions of the acoustic waves, so that the portions of the acoustic waves may have different phases after passing through the plurality of acoustic paths. The method can also include merging the portions of the acoustic waves after the acoustic waves have passed through the plurality of acoustic paths. Because different portions of the acoustic waves may be out of phase, merging the portions of the acoustic waves back can result in destructive interference, which can help attenuate the acoustic waves. In some embodiments, a muffler incorporating the method of attenuating acoustic waves may include more than one acoustic path, each of which may have a different acoustic impedance (e.g., lengths, cross-sectional areas, sudden expansion/contraction, or baffles, etc.). The muffler can include an external acoustic path, which can be modified relatively easily for the purpose of, for example, optimizing the performance of the muffler at a working site. The muffler may be relatively compact and easy to be modified compared to a conventional muffler design.

Generally, a method to attenuate acoustic waves may include directing portions of acoustic waves into a plurality of acoustic paths, where the plurality of acoustic paths may be configured to provide phase shifts in the portions of the acoustic waves. This can result in the plurality portions of the acoustic wave to be out-of-sync relative to each other after passing through the acoustic paths. The method may also include merging the plurality of portions of the acoustic waves after passing through the acoustic paths. Because the acoustic wave portions are out-of-sync relative to each other, merging the plurality of acoustic wave portions may attenuate the acoustic waves (e.g., reduce an amplitude of the acoustic waves compared to the original amplitude of acoustic waves prior to phase shifting caused by being directed through the acoustic paths). In some embodiments, to help provide phase shifts in the portions of the acoustic waves, the acoustic paths may be configured to, for example, have different acoustic impedance (e.g., lengths, cross-sectional areas, sudden expansion/contraction, and/or impeding structures such as for example materials and baffles).

An "acoustic path," as used in this specification, generally refers to a structure that can conduct acoustic waves or allow acoustic waves to pass therethrough.

A "phase shift," as used in this specification, generally means that phases of acoustic waves may be changed when, for example, passing through an acoustic path.

The term "attenuate an acoustic wave," as used in this specification, generally means that an amplitude of an acoustic wave is reduced.

The term "acoustic impedance," as used in this specification, is generally referred to as acoustic properties of an acoustic path. More specifically, "acoustic impedance" is generally referred to as the acoustic characteristic of the corresponding acoustic path related to the external loading, absorption, and/or internal resonances that exist in the acoustic path, which may alter the phase of an acoustic wave as the acoustic wave travels through the acoustic path.

The embodiments disclosed in this specification can be used with a compressor of, for example, an HVAC system. The compressor can be, for example, a screw compressor, a rotatory compressor, a scroll compressor, or the like. The embodiments as disclosed herein can also be used with other machinery that may generate acoustic waves in operation, such as, but not limited to, a combustion engine.

References are made to the accompanying drawings that form a part hereof, and which illustrate embodiments in which the methods and apparatuses described in this specification may be practiced. It is to be understood that the terms used herein are for the purpose of describing the figures and embodiments and should not be regarded as limiting the scope.

FIG. 1 illustrates a schematic diagram of a muffler 100 configured to attenuate acoustic waves 110*a*, according to some embodiments. The schematic diagram illustrates a general principle of configuring the muffler 100 and attenuating acoustic waves 110*a*.

The muffler 100 has an inlet 102 and an outlet 104. The muffler 100 is also configured to have more than one acoustic path 121, 122, and 123. It will be appreciated that the number of the acoustic paths illustrated is exemplary and that the number of paths can vary. The number of acoustic paths can generally be at least two. The acoustic paths 121, 122, and 123 are in communication with the inlet 102 and the outlet 104. The arrows in FIG. 1 generally indicate the directions and distribution of the acoustic waves in operation. As shown, the acoustic waves 110*a* can be directed into the inlet 102. Portions 111, 112, and 113 of the acoustic waves 110*a* can then be directed into the acoustic paths 121, 122, or 123 respectively.

The acoustic paths 121, 122, and 123 are generally configured to provide different acoustic impedances, which may help provide phase shifts to the portions 111, 112 and 113 of the acoustic waves 110*a*.

In the illustrated embodiment, the acoustic waves 110*a* can be divided into three portions 111, 112, and 113, which are directed into the acoustic paths 121, 122, and 123 respectively. After the portions 111, 112, and 113 of the acoustic waves 110*a* pass through the acoustic paths 121, 122, and 123 respectively, the portions 111, 112, and 113 can be merged back at the outlet 104.

Because of, for example, different phase shifts that can be present when the portions 111, 112, and 113 of the acoustic waves 110*a* pass through the acoustic paths 121, 122, and 123, the portions 111, 112, and 113 of the acoustic waves 110*a* may have different phases when merged (e.g., the portions 111, 112, and 113 of the acoustic waves 110*a* are out-of-sync). The out-of-sync portions 111, 112 and 113 can have destructive interference and cancel each other out when merged back, which can help attenuate the acoustic waves (e.g., compare the amplitude of the acoustic waves 110*a* to the amplitude of the acoustic waves 110*b*). In some embodiments, for example, when the portions 111, 112 and 113 may have at or about ¼ to at or about ¾ of wavelength difference in their phases at the outlet 104, the acoustic waves may be attenuated. In some embodiments, the wavelength difference may be at or about ½ of wavelength.

The acoustic paths 121, 122, or 123 may be configured to have different acoustic impedances (e.g., lengths, cross-sectional areas, sudden expansion/contraction, or baffles, etc.), which can help provide different phase shifts in the portions 111, 112, and 113 of the acoustic waves 110*a*. Examples of configurations that can help modify acoustic impedance of an acoustic path are illustrated in FIGS. 3A to 3E.

Figure 2:
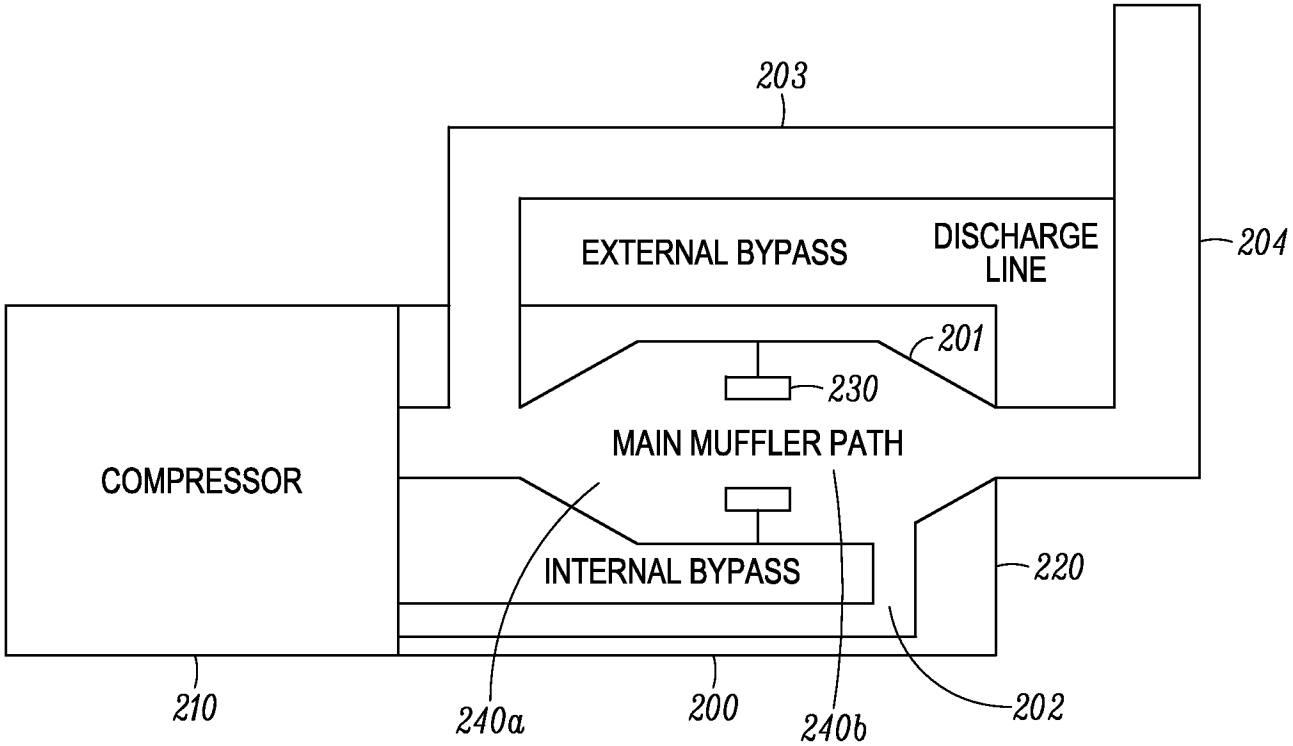
FIG. 2 illustrates a muffler that is coupled to a compressor, according to some embodiments.

FIG. 2 illustrates a muffler 200 that can incorporate the configuration as illustrated in the schematic diagram of FIG. 1, according to some embodiments. The muffler 200 may be coupled to a compressor 210 to, for example, help attenuate acoustic waves produced by the operation of the compressor 210. The muffler 200 can help reduce operational sound of the compressor 210.

As illustrated, the muffler 200 may include a plurality of acoustic paths: a main muffler path 201, an internal muffler path 202 and an external muffler path 203, each of which are in communication with the compressor 210 and a discharge line 204. The muffler 200 may include a muffler housing 220.

The main muffler path 201 and the internal muffler path 202 are housed in the muffler housing 220. The external muffler path 203 is configured to direct a portion of acoustic waves out of the muffler housing 220. The terms "internal" and "external" are relative to a muffler housing (e.g., the muffler housing 220) of a muffler. The term "internal" indicates that a structure is generally enclosed within the muffler housing. The term "external" indicates that a structure is generally not enclosed within the muffler housing. It is to be appreciated that the configurations as illustrated are exemplary.

As illustrated in FIG. 2, the main muffler path 201, the internal muffler path 202 and the external muffler path 203 are generally configured to direct portions of acoustic waves generated by the compressor 210 toward the discharge line 204. The different portions of the acoustic waves can then be merged back in the discharge line 204.

The main muffler path 201, the internal muffler path 202, and the external muffler path 203 may generally be configured to have different acoustic impedances. For example, in some embodiments, the main muffler path 201 may have a contracted portion 230, a first expanded portion 240*a*, and a second expanded portion 240*b*. In some embodiments, the main muffler path 201, the internal muffler path 202, and the external muffler path 203 may be configured to have different lengths. When acoustic waves pass between the contracted portion 230 and the expanded portion 240*a* or 240*b*, the phase of the acoustic waves can change.

In operation, the compressor 210 can produce acoustic waves, which are directed into the muffler 200. The main muffler path 201, the internal muffler path 202, and the external muffler path 203 can be configured to receive a portion of the acoustic waves from the compressor 210. Because, for example, the main muffler path 201, the internal muffler path 202, and the external muffler path 203 have relatively different acoustic impedance, the portion of the acoustic waves passing through these paths can be out-of-sync relative to each other. When the out-of-sync acoustic waves are merged back, the acoustic waves can be attenuated. The acoustic waves can be merged, for example, in the discharge line 204.

It is to be appreciated that the out-of-sync portions of the acoustic waves can also be provided by configuring the main muffler path 201, the internal muffler path 202, and/or the external muffler path 203 to have different lengths. When the portions of the acoustic waves passing through different lengths, the phases of the portions of the acoustic waves can be out-of-sync (e.g., at or about ½ of a wavelength of the acoustic waves) when merged back. When using lengths of the acoustic paths to make the portions of the acoustic waves out-of-sync, the lengths of the acoustic paths may be relatively long, resulting in a relatively large muffler.

In some embodiments, for example, when the compressor 210 is a screw compressor, the main acoustic waves produced by the compressor 210 are at or about 200 Hz to at or about 400 Hz. The lengths of the main muffler path 201, the internal muffler path 202, and/or the external muffler path 203 may be at or about 8 to at or about 10 inches.

It is to be appreciated that it is not necessary for the acoustic waves generated, for example by the compressor 210, to be directed into a plurality of acoustic paths at the same time. The acoustic waves can be directed into the plurality of acoustic paths at different times. For example, as illustrated in FIG. 2, the acoustic waves generated by the compressor 210 are initially directed into the internal muffler path 202 and the main muffler path 201. A portion of the acoustic waves directed into the main muffler path 201 is then directed into the external muffler path 203.

It is also to be appreciated that it is not necessary for the acoustic waves to merge back at the same time, after passing through the plurality of acoustic paths. Different portions of the acoustic waves can be merged at different times. For example, as illustrated in FIG. 2, the portion of the acoustic waves passing through the internal muffler path 202 and the portion of the acoustic waves passing through the main muffler path 201 can be merged first; and then can be merged with the portion of the acoustic waves passing through the external muffler path 203 in the discharge line 204.

Generally, after the portions of the acoustic waves generated by compressor 210 is directed through the main muffler path 201, the internal muffler path 202 and/or the external muffler path 203, the phases of the portions of the acoustic waves may be shifted relative to each other. As a result, the acoustic waves may be attenuated when the portions of the acoustic waves are merged.

There are other ways to provide phase shifts to portions of the acoustic waves by providing different acoustic impedance. Acoustic impedance of an acoustic path can be modified by various configurations. The plurality of acoustic paths, which for example can include the main muffler path 201, the internal muffler path 202, and the external muffler path 203, can incorporate various configurations to modify the acoustic impedance of the acoustic paths. As illustrated in FIG. 2, for example, the main muffler path 201 can include the contracted portion 230, and the expanded portions 240*a* and 240*b* to modify the acoustic impedance of the main muffler path 201.

FIGS. 3A to 3E illustrate exemplary embodiments of configurations that can be used for an acoustic path (e.g., the main muffler path 201, the internal muffler path 202, and/or the external muffler path 203) to modify acoustic impedance of the acoustic path.

Figure 3A:
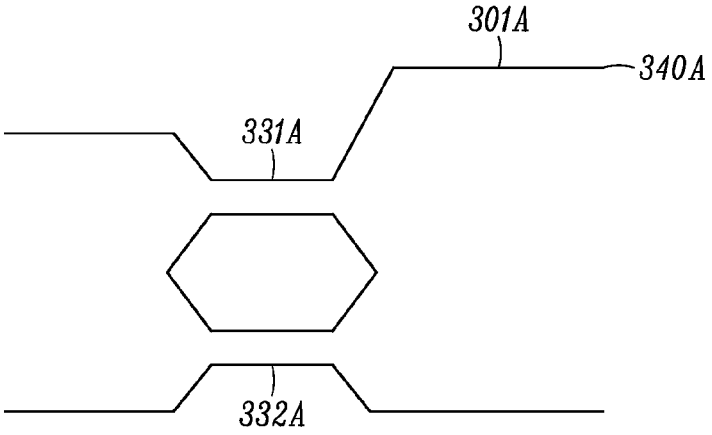
FIGS. 3A to 3E illustrate side section views of exemplary acoustic paths, according to some embodiments.

As illustrated in FIG. 3A, an acoustic path 301A can include more than one contracted portion 331A, 332A that are arranged in parallel. The contracted portions 331A, 332A may be configured to have different sizes/dimensions (e.g., diameters, cross-sectional areas, etc.). The contracted portions 331A, 332A can be in communication with an expanded portion 340A. Generally, contracted portions (e.g., 331A, 332A) and expanded portion (e.g., 340) can help modify the acoustic impedance of the acoustic path 301A.

Figure 3B:
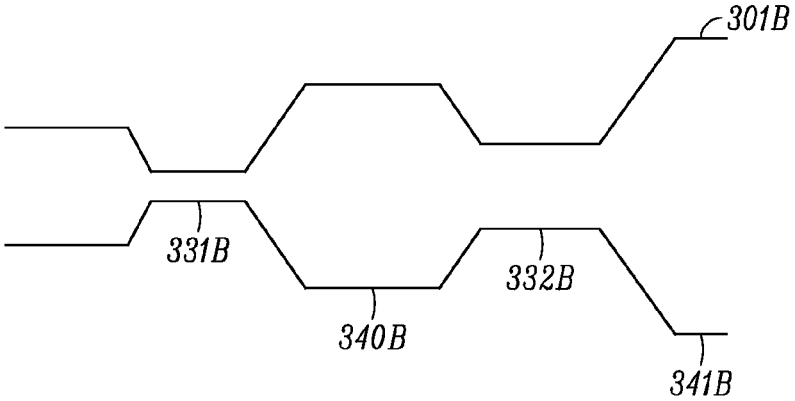

As illustrated in FIG. 3B, an acoustic path 301B can include more than one contracted portion 331B, 332B that are arranged in series. The contracted portions 331B, 332B are in communication with a first expanded portion 340B and a second expanded portion 341B. It is to be appreciated that the size (e.g., cross-sectional area, etc.) of contracted portion 331B may be different from contracted portion 332B. It is also to be appreciated that the size of the first expanded portion 340B may be different from the second expanded portion 341B.

Figure 3C:
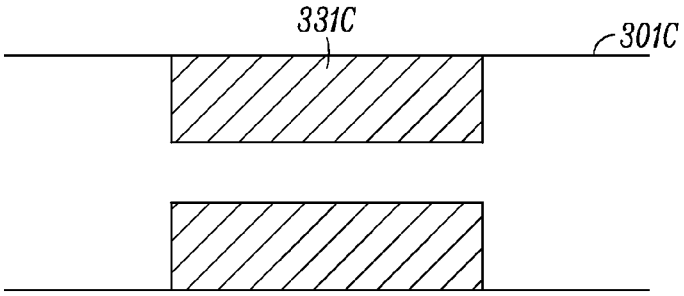

As illustrated in FIG. 3C, an acoustic path 301C may include a material that can help absorb acoustic waves and/or provide phase shifts to acoustic waves.

Figure 3D:
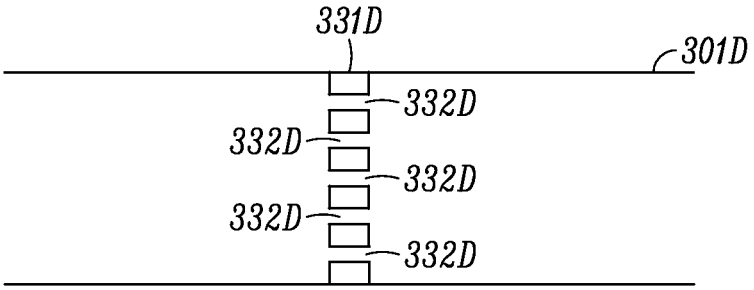

As illustrated in FIG. 3D, an acoustic path 301D can include a perforated plate 331D that include a plurality of apertures 332D. Phase shift can happen when the acoustic waves passes through the apertures 332.

Figure 3E:
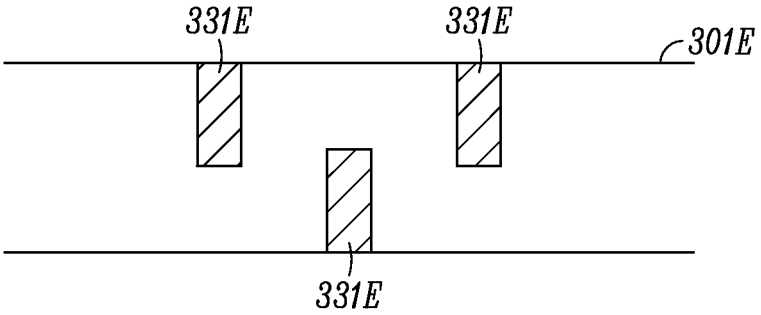

As illustrated in FIG. 3E, an acoustic path 301E may include one or more baffles 331E. The baffles 331E can direct acoustic waves within the acoustic path 301E and can provide phase shifts to the acoustic waves.

By modifying the acoustic impedance of the acoustic paths (e.g., the main muffler path 201, the internal muffler path 202 and/or the external muffler path 203 in FIG. 2), out-of-sync acoustic waves may be provided with relatively short acoustic paths. It is appreciated that a combination of any or all of embodiments illustrated in FIGS. 3A to 3E can make up a suitable acoustic path to attenuate the acoustic waves.

A compressor (e.g., the compressor 210 in FIG. 2) can be a fixed speed compressor or a variable capacity (e.g., variable speed) compressor. When the compressor has a variable capacity, the acoustic waves produced by the compressor may have a relatively wide range of wavelengths compared to, for example, a fixed speed compressor. A muffler may be optimized for different ranges of wavelengths.

For example, in some embodiments, a fixed speed compressor may have main acoustic waves with frequencies at or about 200 Hz to at or about 400 Hz. A variable speed compressor may have main acoustic waves with frequencies at or about 200 Hz to at or about 16,000 Hz. The muffler may be optimized for attenuating acoustic waves for a relatively wide range of frequencies.

Figure 4:
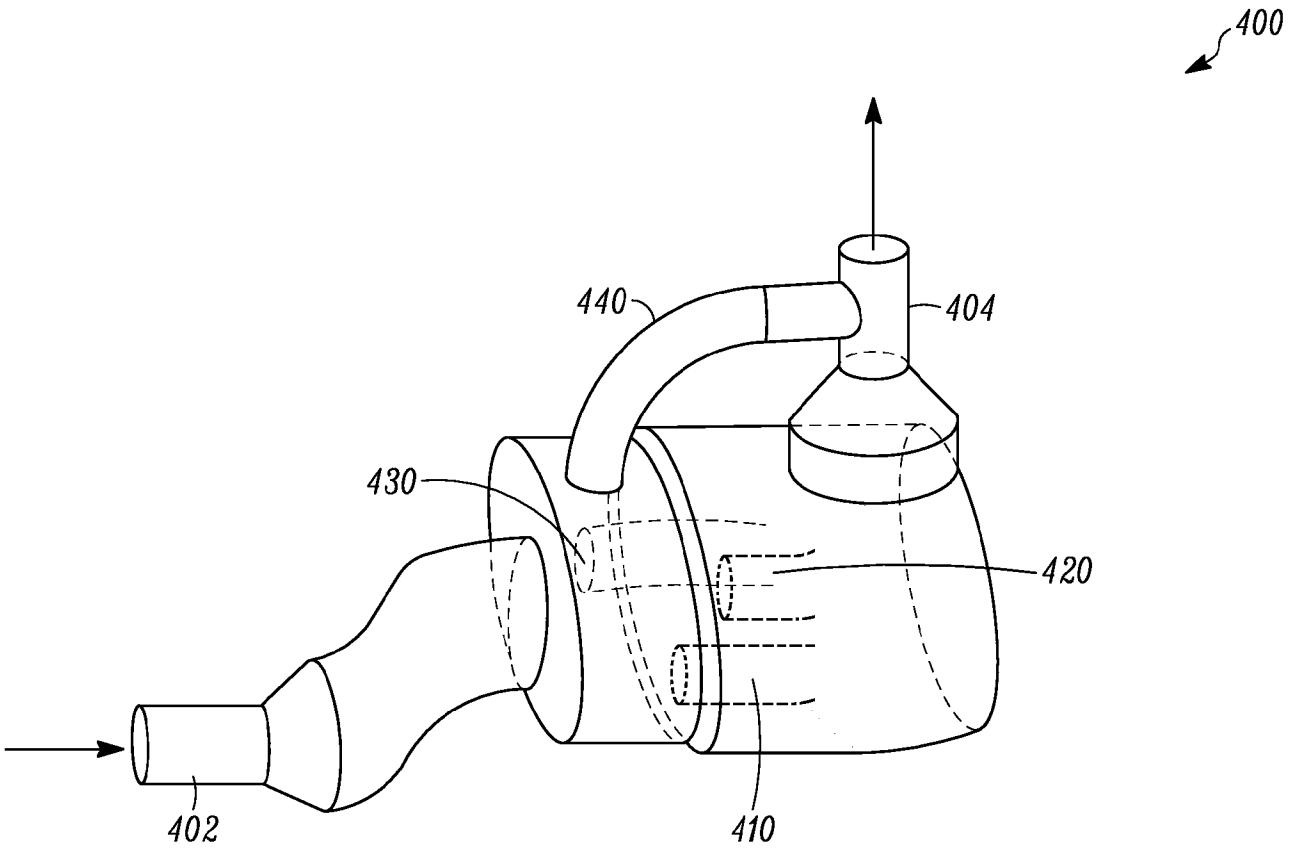
FIG. 4 illustrates a muffler that includes a plurality of internal muffler paths.
Figure 5:
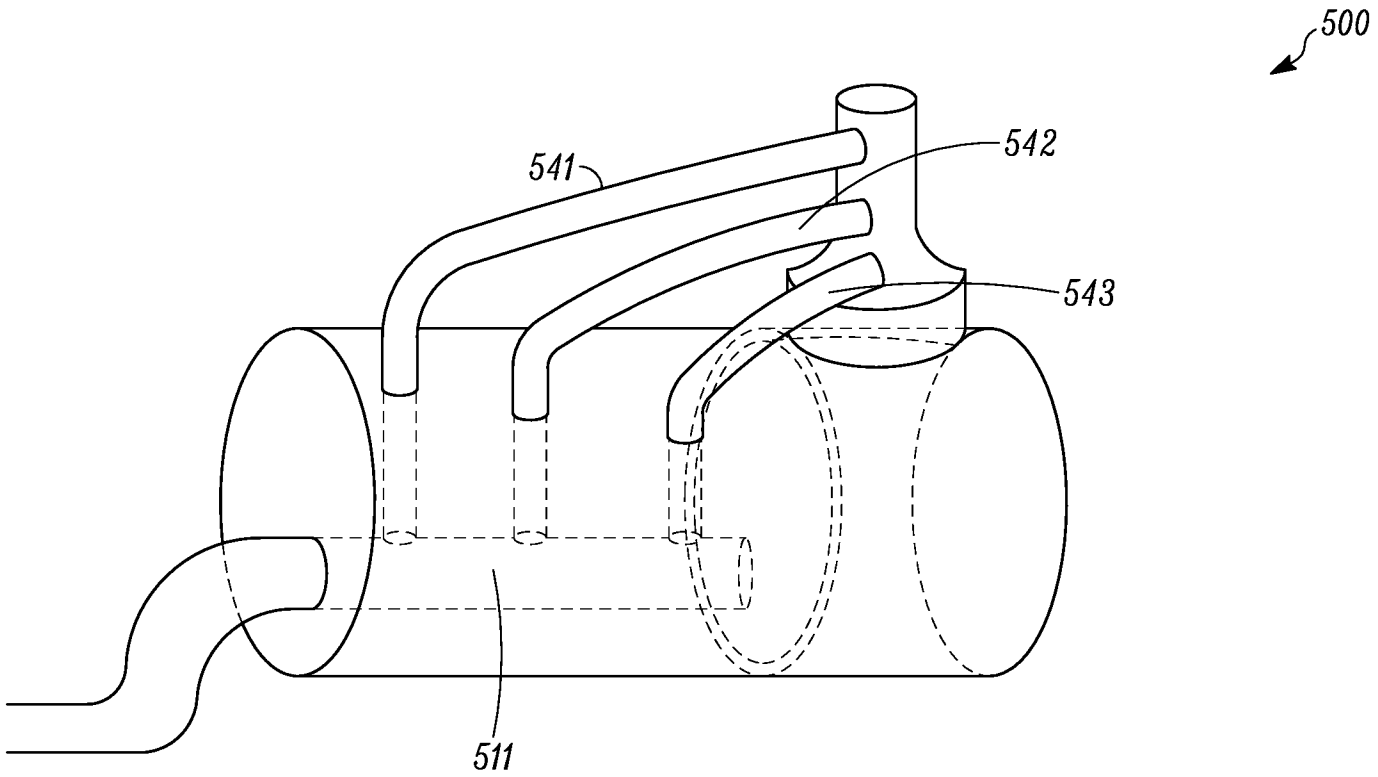
FIG. 5 illustrates a muffler that includes a plurality of external muffler paths.

FIGS. 4 and 5 illustrate two exemplary embodiments of mufflers 400, 500 respectively that may be configured to attenuate acoustic waves with a relatively wide range of wavelengths. The mufflers 400 and 500 may be used with, for example, a variable capacity (e.g., variable speed) compressor. It is to be appreciated that the muffler 400 and 500 can also be used to optimize acoustic wave attenuation for a fixed speed compressor.

As illustrated in FIG. 4, the muffler 400 may include a plurality of internal muffler paths 410, 420, and 430. The muffler 400 also includes an external muffler path 440. The internal muffler paths 410, 420, and 430 and the external muffler path 440 are configured to direct portions of acoustic waves from an inlet 402 toward an outlet 404.

Each of the internal muffler paths 410, 420, and/or 430 may be optimized for different ranges of wavelengths. That is, the internal muffler paths 410, 420, and/or 430 may be configured to provide relatively high degree of phase shift to different ranges of wavelengths. When acoustic waves of a certain range of wavelengths are generated, one or more of the internal muffler paths 410, 420, or 430 can provide phase shifts to portions of the acoustic waves, so that the acoustic waves can be out-of-sync with the portion of the acoustic waves directed through the external muffler path 440.

It is to be appreciated that other design considerations may be taken into account when configuring the muffler 400. For example, a pressure drop when passing through a muffler path may limit how much a cross-sectional area of a contracted portion can be reduced in the muffler path.

In operation, for example, when the compressor varies its operation speed, the range of wavelength of the acoustic waves generated by the compressor can also vary. The acoustic waves may be directed into the muffler. A portion of the acoustic waves may be directed through the external muffler path 440. Other portions of the acoustic waves may be directed through the plurality of internal muffler paths 410, 420, and/or 430. At least one of the internal muffler paths 410, 420, or 430 can make the phase of the portion of the acoustic waves out-of-sync (e.g., at or about ½ of wavelength difference) relative to the portion of the acoustic waves directed through the external muffler path 440

It is to be appreciated that the external muffler path 440 can be modified relatively easily, for example, at a working site, because it is readily accessible. The external muffler path 440 can be optimized/modified at the working site by, for example, changing the length of the external muffler path 440 and/or modifying acoustic impedance of the external muffler path 440 by adding or removing other features that can affect acoustic impedance (e.g., any one or more of the configurations as shown in FIGS. 3A to 3E).

FIG. 5 illustrates that the muffler 500 can have a plurality of external muffler paths 541, 542, 543. In the illustrated embodiment, the muffler 500 can include one internal muffler path 511. The plurality of muffler paths 541, 542, and/or 543 may be optimized for a different range of wavelengths. That is, the external muffler paths 541, 542, and/or 543 can be configured to provide relatively high degrees of phase shift to different ranges of wavelengths. When acoustic waves of a certain range of wavelengths are generated, one or more of the external muffler paths 541, 542, and/or 543 can provide phase shifts to portions of the acoustic waves, so that the phase of the acoustic waves can be out-of-sync with the portion of the acoustic waves directed through the internal muffler path 540.

In operation, when the compressor varies its operation speed, the range of wavelengths of the acoustic waves generated by the compressor can also vary. The acoustic waves can be directed into the muffler. A portion of the acoustic waves may be directed through the internal muffler path 511. Other portion of the acoustic waves may be directed through the plurality of external muffler paths 541, 542, and/or 543. At least one of the external muffler paths 541, 542, and/or 543 can make a portion of the acoustic waves out-of-sync (e.g., at or about ¼ of wavelength) relative to the portion of the acoustic waves directed through the internal muffler path 540.

It is to be appreciated that in some embodiments, a muffler can include a plurality of external muffler paths and a plurality of internal muffler paths.

Since the external muffler paths 541, 542, and/or 543 can be modified relatively easily, the muffler 500 may be optimized and/or modified relatively easily at a worksite. For example, the acoustic impedance of the external muffler paths 541, 541, and/or 543 can be modified based on the wavelength range of the acoustic waves at the worksite.

It is to be appreciated that an existing muffler without an external muffler path may be retrofitted to include one or more external muffler paths, so that acoustic waves with out-of-sync phases can be provided to attenuate the acoustic waves.

Aspects

Any of aspects 1 to 7 can be combined with aspect 8.

Aspect 1. A muffler comprising:

a first acoustic path; and a second acoustic path;

wherein the first acoustic path and the second acoustic path are configured to provide different phase shifts to acoustic waves, and the first acoustic path and the second acoustic path are configured to direct acoustic waves to merge after the first and second acoustic paths.

Aspect 2. The muffler of aspect 1, wherein the first acoustic path and the second acoustic path have different lengths.

Aspect 3. The muffler of aspect 1, wherein the first acoustic path and the second acoustic path have different acoustic impedance.

Aspect 4. The muffler of aspect 1, further comprising:

a muffler housing, wherein the first acoustic path is internal to the muffler housing and the second acoustic path is external to the muffler housing.

Aspect 5. The muffler of aspect 1, further comprising:

a third acoustic path, where in the third acoustic path are configured to provide different phase shifts than the first and second acoustic paths.

Aspect 6. The muffler of aspect 5, further comprising:

a muffler housing, wherein the first and second acoustic paths are internal to the muffler housing and the third acoustic path is external to the muffler housing.

Aspect 7. The muffler of aspect 5, further comprising:

a muffler housing, wherein the first and second acoustic paths are external to the muffler housing and the third acoustic path is internal to the muffler housing.

Aspect 8. A method of attenuating acoustic waves, comprising:

providing a first degree of phase shift to a first portion of the acoustic waves;

providing a second degree of phase shift to a second portion of the acoustic waves; and merging the first portion of the acoustic waves and the second portion of the acoustic waves;

wherein the first degree of phase shift and the second degree of phase shift are different.

The terminology used in this specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A muffler, comprising:

a muffler housing having an inlet and an outlet;

a first acoustic path internal to the muffler housing; and a second acoustic path exiting from the muffler housing at a location between the inlet and the outlet, wherein the first acoustic path and the second acoustic path are configured to provide different phase shifts to acoustic waves, the first acoustic path directs a first portion of acoustic waves received from the inlet of the muffler housing toward the outlet of the muffler housing, the second acoustic path receives a second portion of the acoustic waves from the muffler housing and directs the second portion of the acoustic waves externally from the muffler housing, and the first acoustic path and the second acoustic path direct the first and second portions of acoustic waves to merge externally from the muffler housing after the first and second acoustic paths and after the outlet.

2. The muffler according to claim 1, wherein the first acoustic path and the second acoustic path have different lengths.

3. The muffler according to claim 1, wherein the first acoustic path and the second acoustic path have different acoustic impedances.

4. The muffler according to claim 1, further comprising:

a third acoustic path, wherein the third acoustic path is configured to provide a different phase shift than the first and second acoustic paths.

5. The muffler according to claim 4, wherein the third acoustic path is internal to the muffler housing.

6. The muffler according to claim 4, wherein the third acoustic path is external to the muffler housing.

7. A method of attenuating acoustic waves in a muffler of a heating, ventilation, and air conditioning (HVAC) system, the muffler including a muffler housing having an inlet and an outlet, the method comprising:

providing a first degree of phase shift to a first portion of the acoustic waves via a first acoustic path, the first acoustic path being internal to the muffler housing and downstream of the inlet of the muffler housing;

providing a second degree of phase shift to a second portion of the acoustic waves via a second acoustic path, the second acoustic path exiting from and being external to the muffler housing and downstream of the inlet of the muffler housing; and merging the first portion of the acoustic waves and the second portion of the acoustic waves externally from the muffler housing at a location downstream of the muffler housing outlet;

wherein the first degree of phase shift and the second degree of phase shift are different.

8. The method according to claim 7, further comprising:

providing a third degree of phase shift to a third portion of the acoustic waves.

9. The method according to claim 8, wherein the third degree of phase shift is different from the first and second degrees of phase shift.

10. A method of modifying a muffler of a compressor in a heating, ventilation, and air conditioning (HVAC) system, the muffler including a first acoustic path disposed within a housing of the muffler, the method comprising:

adding a second acoustic path to the muffler, the second acoustic path exiting from and being disposed externally to the housing, wherein an inlet of the second acoustic path is disposed at an inlet end of the muffler such that first acoustic waves traverse the first acoustic path and second acoustic waves traverse the second acoustic path, the second acoustic path being configured to merge with the first acoustic path at an outlet end of the muffler external from the housing and downstream of an outlet from the housing.

11. The method according to claim 10, further comprising:

adding a third acoustic path to the muffler, wherein an inlet of the third acoustic path is disposed at the inlet end of the muffler such that third acoustic waves traverse the third acoustic path, the third acoustic path being configured to merge with the first and second acoustic paths at the outlet end of the muffler.

12. The method according to claim 11, wherein the third acoustic path is disposed internally of the housing.

13. The method according to claim 11, wherein the third acoustic path is disposed externally to the housing.

* * * * *